US006645099B2

(12) United States Patent
Gaff et al.

(10) Patent No.: US 6,645,099 B2
(45) Date of Patent: Nov. 11, 2003

(54) MOISTURE-ABSORBING RUBBER-COVERED GAME BALL

(75) Inventors: Bradley L. Gaff, Newburgh, IN (US); Hsin Feng Lin, Taichung (TW)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 10/097,288

(22) Filed: Mar. 14, 2002

(65) Prior Publication Data

US 2003/0176246 A1 Sep. 18, 2003

(51) Int. Cl.[7] ..... A63B 41/08
(52) U.S. Cl. ..... 473/596; 473/605
(58) Field of Search ..... 473/594, 596, 473/597, 603, 604, 605, 599, 549, 300

(56) References Cited

U.S. PATENT DOCUMENTS

| | | | | | |
|---|---|---|---|---|---|
| 1,614,853 | A | | 1/1927 | Schwartz | |
| 2,494,806 | A | | 1/1950 | Gibson | |
| 2,819,753 | A | * | 1/1958 | Nogue | 473/604 |
| 3,972,528 | A | * | 8/1976 | McCracken et al. | 473/566 |
| 4,053,676 | A | * | 10/1977 | Kaminstein | 473/549 |
| 4,284,275 | A | * | 8/1981 | Fletcher | 473/549 |
| 5,040,795 | A | * | 8/1991 | Sonntag | 473/596 |
| 5,069,935 | A | * | 12/1991 | Walters | 473/599 |
| 5,181,717 | A | | 1/1993 | Donntag et al. | |
| 5,636,835 | A | * | 6/1997 | Schindler et al. | 473/605 |
| 6,024,661 | A | | 2/2000 | Guenther et al. | 473/605 |

* cited by examiner

*Primary Examiner*—Steven Wong

(57) ABSTRACT

A game ball includes an outer spherical surface, which is formed from foamed rubber, which provides moisture-absorbing pores.

10 Claims, 1 Drawing Sheet

MOISTURE-ABSORBING RUBBER-COVERED GAME BALL

BACKGROUND OF THE INVENTION

This invention relates to game balls, and, more particularly, to a game ball having a foamed or sponge rubber outer surface, which has pores for absorbing moisture.

Game balls such as basketballs, soccer balls, and footballs conventionally include an inflatable bladder and a cover. The bladder may be reinforced with windings of nylon thread, polyester thread, etc. The cover is conventionally formed from panels of leather, synthetic leather, rubber, etc.

Synthetic leather covers have been well received as a substitute for more expensive leather covers. Synthetic covers are soft and easy to grip when dry. However, a synthetic leather cover becomes difficult to grip when the cover is wet with sweat. A genuine leather cover, particularly after breaking in, has small holes, which absorb sweat so that the ball retains its gripability. On the other hand, a synthetic leather cover commonly includes a polyurethane coating which is relatively impervious to sweat.

U.S. Pat. No. 6,024,661 describes a game ball with a synthetic leather cover, which has holes or pores for absorbing moisture such as sweat. The outer surface of the ball is formed from wet-coagulated polyurethane. The skin of the wet-coagulated polyurethane is ruptured when the pebbled surface of the ball is molded so that pores are formed on the sides of the pebbles.

Rubber covered basketballs are cheaper than synthetic leather covered basketballs. As a result, rubber covered basketballs are preferred by many buyers and users. Because of the lower cost, most basketball companies sell more rubber-covered basketballs than leather or synthetic leather covered basketballs.

A conventional rubber cover has a non-porous surface, which is impervious to moisture. Accordingly, a rubber-covered basketball does not have the capability of absorbing sweat or other moisture.

SUMMARY OF THE INVENTION

A game ball such as a basketball includes a cover formed from foamed or sponge rubber or synthetic rubber. The foaming process forms holes or pores in the outer surface of the cover which can absorb moisture.

DESCRIPTION OF THE DRAWING

The invention will be explained in conjunction with illustrative embodiments shown in the accompanying drawing, in which.

DESCRIPTION OF SPECIFIC EMBODIMENT

Figure 1:
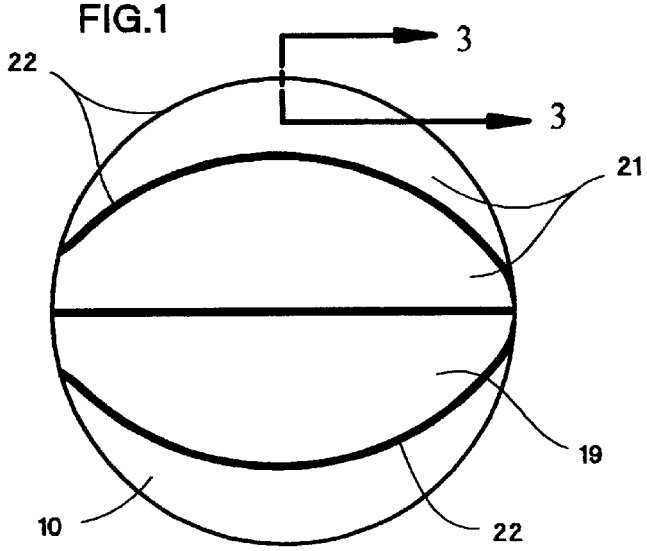
FIG. 1 illustrates a basketball formed in accordance with the invention.

The invention will be explained with reference to a basketball 10 illustrated in FIG. 1. It will be understood, however, that the invention can be used with other inflatable game balls, for example, soccer balls, footballs and volleyballs.

The basketball includes an inflatable bladder 11 (FIG. 3) which is reinforced with a layer of windings 12. The bladder 11 may be manufactured in the conventional manner from conventional bladder materials. The bladder is preferably formed primarily of rubber. In the preferred embodiment the bladder was made from 80% butyl rubber and 20% natural rubber.

Figure 2:
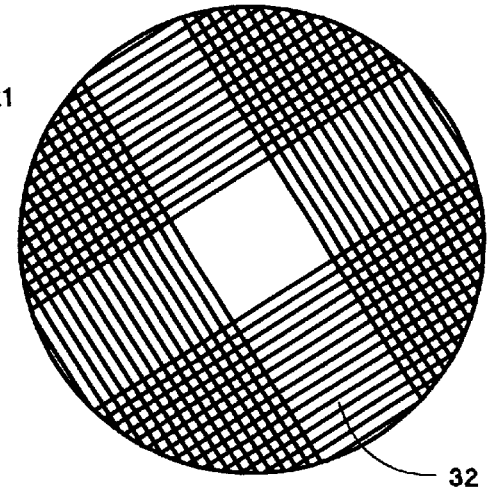
FIG. 2 illustrates a wound bladder before the cover is applied.
Figure 3:
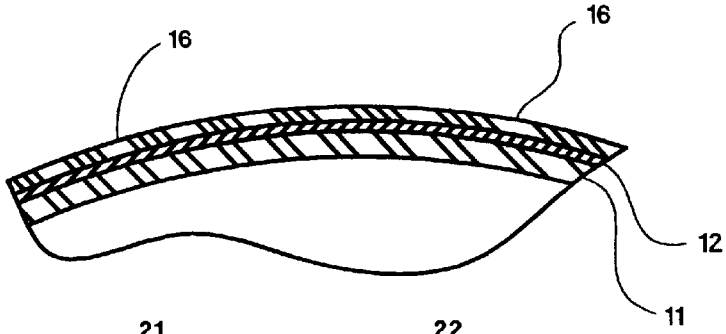
FIG. 3 is a fragmentary sectional view of the basketball before the final molding operation.

The bladder is inflated and placed in a vulcanizing or curing mold where the bladder is cured at 160° C. After curing, the inflated bladder is wound with reinforcing thread 14 (FIG. 2) which forms the layer of windings 12 (FIG. 3). In an alternative preferred embodiment, the ball 10 can be formed without the reinforcing thread 14.

Flat sheets or panels 16 of rubber are laid on the wound bladder (FIG. 3). The rubber sheets include a foaming agent, and one specific composition of rubber is described in Table 1. The listed ingredients are conventional and well known in the art.

TABLE 1

SPONGE RUBBER RECIPE
(amount I grams)

| | |
|---|---|
| RSS NO. 1 | 60.00 |
| BRO1 | 20.00 |
| SBR1778 | 20.00 |
| Zinc Oxygen | 4.68 |
| Accelerator, M | 0.50 |
| Accelerator, DM | 0.60 |
| Accelerator, TS | 0.18 |
| Sulfur | 2.40 |
| Antioxidant Sp | 0.50 |
| Antioxidant Ns | 0.60 |
| Hakuenka CC | 40.00 |
| Carbonic Black FEF | 10.00 |
| Carbonic Black HAF | 10.00 |
| Process bil | 8.00 |
| Stearic Acid | 1.00 |
| Cellmike | 4.50 |
| Total | 181.18 grams |

The product is then placed in a spherical mold and heat molded at 160° C. while the bladder is inflated. During the molding process the rubber panels 16 melt into the windings and fuse to the rubber bladder. The panels also fuse to each other. The panels are thereby mechanically and chemically bonded to, and integrated with, the wound bladder.

Figure 5:
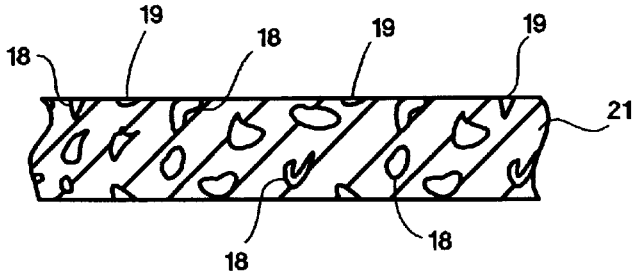
FIG. 5 is an enlarged view of a portion of FIG. 4.

During the molding step, a foaming agent in the sponge rubber panels 16 foams and creates a cellular structure (see FIG. 5) in the sponge rubber. Some of the cells 18 are open at the outer surface of the rubber and form holes or pores 19 in the surface.

Figure 4:
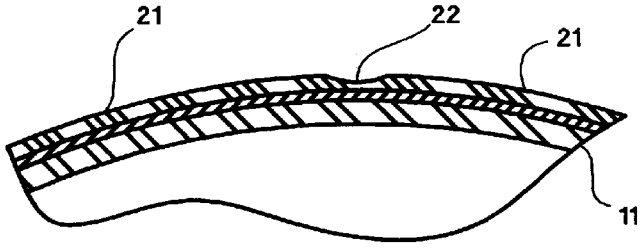
FIG. 4 is a fragmentary sectional view of the completed basketball.

After the molding step, the sponge rubber forms cover panels 21 of the basketball (FIG. 4). The mold also forms traditional channels or seams 22 between adjacent cover panels. The channels advantageously have a concave outer surface.

When moisture, e.g., sweat, comes into contact with the cover of the ball, the moisture passes into the pores 19. It is believed that moisture may be drawn into the pores by capillary action. The moisture is thereby absorbed by the cover and does not interfere with gripability of the ball.

The preferred embodiment of the cover uses natural rubber, which includes a foaming agent. However, the cover could also be formed from synthetic rubber, e.g., a diene polymer such as polybutadiene. The cover can also be formed from conventional foamed shoe sole material, which has the advantage of excellent durability.

In an alternative preferred embodiment, the rubber panels 16 can further include a surfactant for facilitating the panels 16 capability for absorbing moisture. The surfactant acts as a type of emulsifying agent to reduce the surface tension of a fluid, such as sweat or perspiration, which comes in contact with the panel 16. By reducing the surface tension of the fluid, the surfactant reduces or prevents beading of the fluid. The surfactant thereby enables the fluid to be more readily absorbed or surrounded by the material of the panels 16. The fluid is then drawn away from the outer surface of the panels 16 through the pores 19. The surfactant can be integrally formed with the cover panels 16 or applied to the outer surface of the cover panels 16, via spraying, dipping or other conventional means, after the cover panels 16 are formed.

While in the foregoing specification a detailed description of specific embodiments was set forth for the purpose of illustration, it will be understood that many of the details hereingiven may be varied considerably by those skilled in the art without departing from the spirit and scope of the invention.

We claim:

1. A game ball having spherical outer surface comprising:

an inflatable bladder, a layer of windings over the bladder, a single layer of foamed rubber molded over the layer of windings, the layer of foamed rubber forming the spherical outer surface of the ball and having pores which are open at the spherical outer surface whereby the pores can absorb moisture on the surface of the ball.

2. The game ball of claim 1, wherein the layer of foamed rubber further comprising a surfactant integrally formed with the layer of foamed rubber, the surfactant adapted for facilitating moisture absorption by the ball.

3. The game ball of claim 1, further comprising a layer of surfactant applied to the outer surface of the game ball.

4. A game ball having a spherical outer surface comprising:

an inflatable bladder;

a layer of windings generally covering the bladder; and a plurality of rubber sheets bonded together to form the outer surface and to cover the layer of windings, each rubber sheet including a foaming agent, the rubber sheets and the foaming agent forming a cellular structure within the rubber sheets and forming a plurality of holes on the outer surface.

5. The game ball of claim 4, wherein the rubber sheets are formed from a rubber selected from the group consisting of a natural rubber, a synthetic rubber, a diene polymer, a polybutadiene and combinations thereof.

6. The game ball of claim 4, wherein the rubber sheets further include a surfactant for facilitating the ability of the rubber sheets to absorb moisture.

7. The game ball of claim 6, wherein the surfactant is integrally formed with the rubber sheets.

8. The game ball of claim 6, wherein the surfactant is applied to the outer surface.

9. The game ball of claim 8, wherein the surfactant is applied to the outer surface through one of spraying, dipping, painting and a combination thereof.

10. The game ball of claim 4, wherein the rubber sheets are integrally connected with the layer of windings.

* * * * *